United States Patent [19]

Noorily et al.

[11] Patent Number: 4,619,494

[45] Date of Patent: Oct. 28, 1986

[54] SHIELDED ELECTRICAL CONNECTOR

[75] Inventors: Peter Noorily, Bridgewater; Joseph P. Slachetka, Ringoes, both of N.J.

[73] Assignee: Thomas & Betts Corporation, Raritan, N.J.

[21] Appl. No.: 785,313

[22] Filed: Oct. 7, 1985

[51] Int. Cl.[4] ..... H01R 13/20

[52] U.S. Cl. ..... 339/103 M; 339/143 R

[58] Field of Search ..... 339/103 R, 103 M, 105, 339/106, 143 R

[56] References Cited

U.S. PATENT DOCUMENTS

| | | | |
|---|---|---|---|
| 4,009,923 | 3/1977 | Aistleitner | 339/143 |
| 4,120,553 | 10/1978 | Muz | 339/91 |
| 4,127,315 | 11/1978 | McKee | 339/103 |
| 4,215,236 | 7/1980 | Reiser | 174/59 |
| 4,272,148 | 6/1981 | Knack, Jr. | 339/143 |
| 4,358,178 | 11/1982 | Guy | 339/103 |
| 4,398,780 | 8/1983 | Novotny et al. | 339/49 |
| 4,415,223 | 11/1983 | Asick | 339/276 |
| 4,449,778 | 5/1984 | Lane | 339/143 |
| 4,453,798 | 6/1984 | Asick et al. | 339/143 |
| 4,457,576 | 7/1984 | Cosmos et al. | 339/143 |
| 4,493,525 | 1/1985 | Hall et al. | 339/143 |
| 4,501,459 | 2/1985 | Chandler et al. | 339/48 |
| 4,508,415 | 4/1985 | Bunnell | 339/143 |
| 4,549,780 | 10/1985 | Bertini et al. | 339/107 |

OTHER PUBLICATIONS

IBM Technical Disclosure Bulletin, "Hermaphroditic Connector" by R. T. Evans, vol. 16, No. 5, Oct. 1973, pp. 1505–1506.

*Primary Examiner*—Eugene F. Desmond

*Attorney, Agent, or Firm*—Robert M. Rodrick; Salvatore J. Abbruzzese

[57] ABSTRACT

A shielded electrical connector is provided for electrical attachment to a shielded electrical cable of the type including a plurality of electrical conductors and a shielding braid surrounding the conductors. The connector includes an electrically insulative housing including a base and a separable cover attached thereto, the housing defining a mating end for electrical connection to an electrical component and a cable receiving end for receipt of the electrical cable. The housing base defines first and second open compartments divided by a partition extending therebetween. The first compartment is disposed adjacent the connector mating end and supports a plurality of electrical contacts therein. In the preferred arrangement, only the first compartment of the connector is electrically shielded. Shielding is provided by a conductive member including at least one conductive wall between the first and second compartments, the wall including an open slot for receipt of and engagement with the shielding braid of the electrical cable. Engagement with the conductive wall provides not only electrical connection to the cable shielding braid, but also provides cooperative strain relief thereto. The second compartment includes walls define a plurality of accessible ports for receipt of the cable in selectively different directions. These accessible ports are preferably in the form of slidably removable gates mounted on the base walls. The second compartment is of sufficient size to accommodate bending of the cable therein from the strain relief to any one of the accessible ports.

15 Claims, 15 Drawing Figures

SHIELDED ELECTRICAL CONNECTOR

FIELD OF THE INVENTION

The present invention relates to improvements in electrical connectors that are particularly useful in the data communications industry.

BACKGROUND OF THE INVENTION

With the ever increasing use of data communications equipment there is a growing need for electrical connectors for terminating electrical cables thereto and for connecting data equipment or components thereof to each other. Electrical connectors of this type are shown, for example, in U.S. Pat. No. 4,449,778 (issued on May 22, 1984) and U.S. Pat. No. 4,501,459 (issued on Feb. 26, 1985). These connectors include electrical shields for electromagnetic emission protection as well as for electrical and mechanical securement to a metallic braid of an electrically shielded cable. Additionally, these connectors provide for the cable to be able to exit the connector housing in different directions, such as in the axial or orthogonal directions. Another feature shown in these known connectors is the use of shunting or shorting bars to provide a closed-loop connection between selected contact terminals when the connector is in a non-connected condition. Such a feature is intended to protect the equipment from spurious and potentially damaging electrical signals which may be transmitted along a link-line to data equipment, as a result of misconnections or electrical strays.

While those shielded type electrical connectors contain desirable features for data communications applications, they also have some disadvantages. For example, an effort to achieve the desired shielding, closed-loop shorting and multiple cable exiting features, these known connectors require complex structures that are difficult to use and assemble, particularly in the field. In addition, the latching mechanisms adapted for attachment to equipment panels or to like connectors can result in a disconnection from either the equipment panel or the other electrical connector. In an effort to compensate for this problem, a separate, external wedge is provided for subsequent attachment to the electrical connector in a manner to prevent the latching mechanism from separating in use. Accordingly, while it is advantageous to maintain some of the features of the known connectors, it is also desirable to provide improvements to overcome their various problems.

SUMMARY OF THE INVENTION

It is an object of the present invention to provide an improved electrical connector.

It is another object of the present invention to provide an improved shielded electrical connector.

In accordance with the invention, a shielded electrical connector comprises a housing defining a mating end for electrical connection to an electrical component and a cable receiving end for receipt of an electrical cable having a plurality of electrical conductors. The housing includes first and second communicating compartments, the first compartment being adjacent the mating end of the housing and supporting a plurality of electrical contacts therein for electrical engagement with the cable conductors. The housing supports an electrically conductive shield in the first compartment. Strain relief means is disposed between the first and second compartments for engaging a portion of the electrical cable and retaining the cable thereat. The second compartment has walls defining a plurality of accessible ports for receipt of the cable in selectively different locations. The second compartment is of sufficient size to accommodate bending of the cable therein from the strain relief means to any one of the ports.

DETAILED DESCRIPTION OF THE PREFERRED EMBODIMENTS

Figure 1:
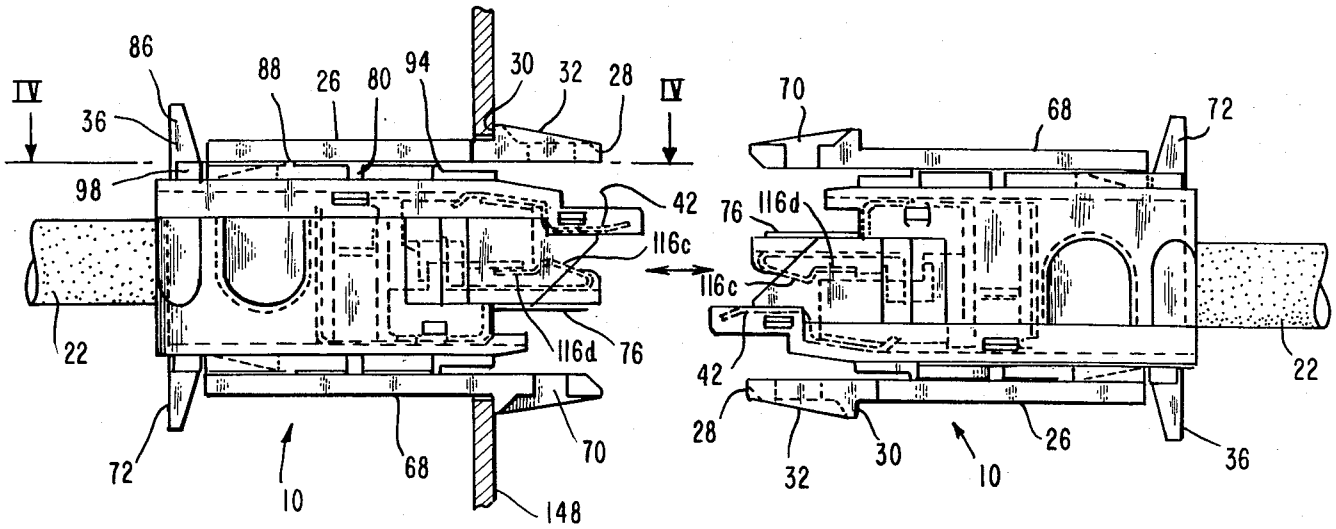
FIG. 1 is a side elevation view, partly in section, of two improved electrical connectors, one of which is shown in latched relation to a panel of an electrical component and the other in alignment for connection to the one connector.

Referring now to the drawing, there is shown in FIG. 1, a pair of electrical connectors disposed to be mechanically latched and electrically connected. Each connector generally designated by reference numeral 10 is of hermaphroditic construction and is identical to the other. To effect connection of the pair of connectors, one of the connectors 10 is rotated aoout its central axis 180° relative to the other. As the connectors 10 are of identical construction, only the details of one of the connectors will be described hereinafter.

Figure 2:
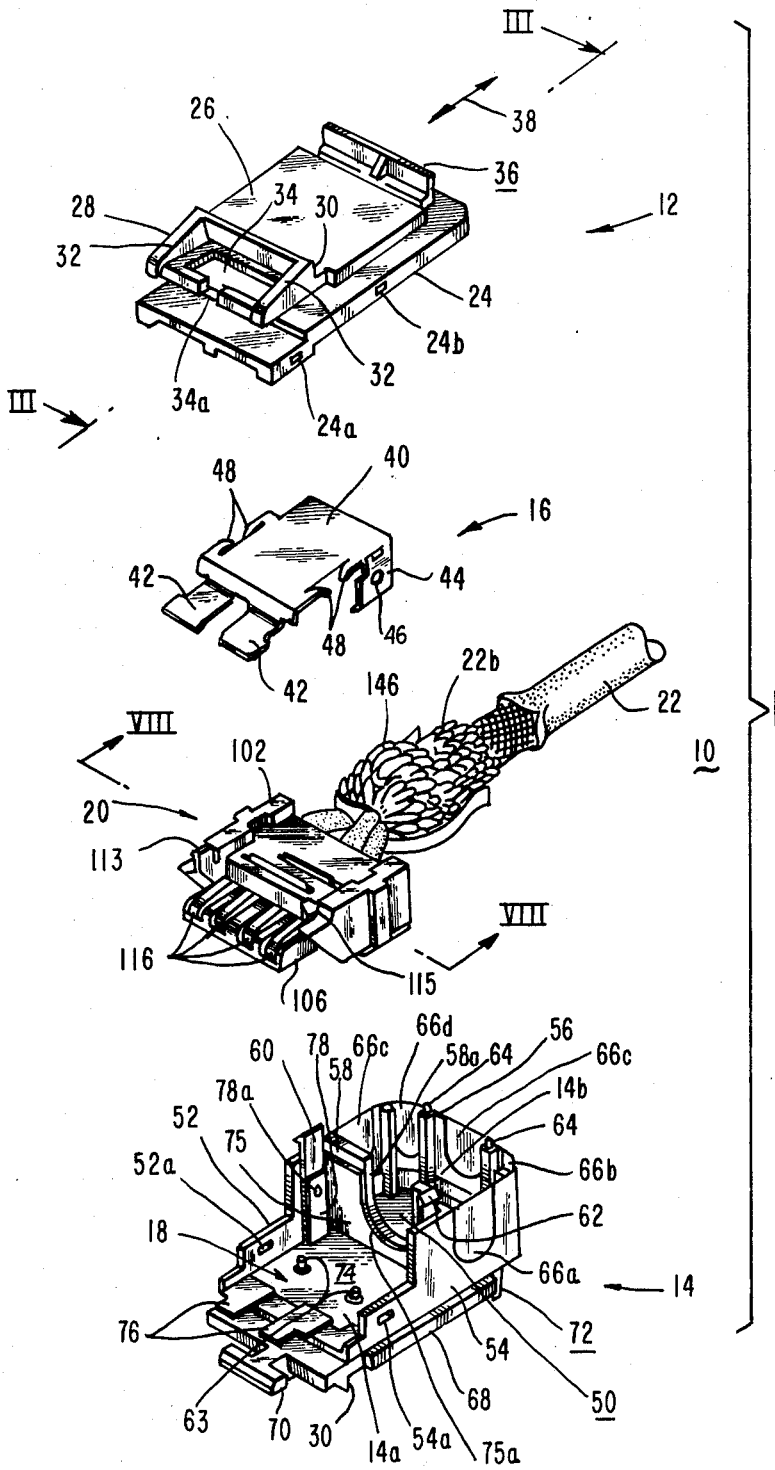
FIG. 2 is an exploded, perspective view of an electrical connector in accordance with the present invention.

Turning now to FIG. 2, the connector 10 comprises an insulative housing including a cover 12 and a base 14, an upper electrically conductive shield 16, a lower electrically conductive shield 18 (shown in assembly with the base 14) and a cable termination sub-assembly 20, shown terminated to an electrical cable 22.

Cover 12 includes an elongate, generally planar lid 24 and a relatively rigid, deflectable arm 26, pivotally mounted on the lid 24. The lid 24 and the arm 26 secured thereto are preferably formed integrally from plastic material. Toward the mating end of the cover 12, the arm 26 includes a latch portion 28 comprising a shoulder 30 facing toward the rear of the arm 26 and a pair of surfaces 32 sloping downwardly toward the front mating end of the arm 26. Disposed between sloping surfaces 32 is a latch opening 34, generally C-shaped and having a front throat 34*a*, the opening 34 and throat 34*a* adapted to receive a complementary T-bar latch located on the base of another like connector, as will be described. A separate, preferably plastic lever 36 is captively contained in the cover 12, the lever 36 being disposed between the lid 24 and the arm 26 for slidable movement in the longitudinal direction as indicated by arrow 38 in FIG. 2 in manner, as will be detailed below, to effect locking and un-locking relation with another like electrical connector. Openings 24*a* and 24*b* are provided in both of the side walls of the lid 24 for cooperatively retaining the connector components in joined relation as will be set forth.

Upper shield 16, formed preferably by stamping a flat strip of metal, comprises a generally flat portion 40 and a pair of tongues 42 projecting outwardly from the portion 40 in an offset substantially parallel therewith. A pair of tabs 44 (only one of which can be seen in FIG. 2) depend downwardly from the flat portion 40 and substantially orthogonal thereto. Disposed on each of the tabs 44 is a protuberance 46 serving as a means for providing electrical engagement with the lower shield 18. On each side of the flat portion 40 there are downwardly projecting, resilient tines 48 defining a means for securing the shield 16 to a post (not shown) projecting from the undersurface of the lid 24.

Base 14 comprises a floor 50 from which upstanding, transversely spaced sidewalls 52, 54 and rear wall 56 extend. Disposed transversely across the width of the base 14 is a partition 58 having an open slot 58*a* formed therein approximately centrally between the sidewalls 52 and 54. The partition defines generally a front compartment 14*a* adjacent the front, mating end of the base 14 and a rear compartment 14*b* adjacent the rear end of the base 14. Projecting upwardly from the floor 50 adjacent the respective side walls 52, 54 are locking tabs 60, 62 for resilient locking engagement with the openings 24*b* in the cover lid 24. Projecting upwardly from the rear wall 56 are further tabs 64 for additional engagement with the cover lid 24. Projecting upwardly from the floor 50 in front compartment 14*a* are a pair of posts 63 that are arranged to enter openings (now shown) in the underside of the cable termination sub-assembly 20, so as to provide a means of maintaining the position of the sub-assembly 20 relative to the base 14 in assembly. Openings 52*a* and 54*a* are provided in the respective side walls for engagement with locking elements in the termination sub-assembly 20.

Disposed around the rear compartment 14*b* are repeatedly removable gates 66*a*–66*e*. Gates 66*a*–66*e* are preferably slidably mounted in the base walls and provide accessible ports at five different locations for exiting of the electrical cable, as will be described. The ports are located to permit cable exiting in the axial direction (66*c*), orthogonal directions (66*a* and 66*e*) and in the 45° directions (66*b* and 66*d*). Although five ports are shown, it should be understood that any suitable number of accessible ports may be provided. In addition, while it is preferably to have slidable gates defining such accessible cable ports, it should be appreciated that other accessible ports such as conventional knock-outs may also be employed.

Still referring to FIG. 2 and also to FIG. 1, the base 14 includes a relatively rigid, deflectable arm 68, similar to arm 26 in the cover. Arm 68 is pivotally mounted on the bottom surface of base floor 50. Toward the mating, front end of base 14, there is a projecting latch 70 in the form of a T-bar for complementary engagement with the latch portion 28 of the cover 12 of another identical connector. A separate, sliding lever 72 is captively contained in the base 14, the lever 72 being mounted between the deflectable arm 68 and the floor 50 of the base 14. The base 14, except for the removable gates 66*a*–66*e* and the lever 72 is preferably, integrally formed of plastic material. The gates 66*a*–66*e* are preferably formed of plastic as an integral member interconnected by severable webs for ease of fabrication and assembly. The lever 72 is also preferably formed of plastic.

The lower shield 18 is formed preferably by stamping from a sheet of flat metal. The shield 18 comprises a generally flat portion 74 from which a pair of tongues 76 project substantially parallel to and offset from the flat portion 74. Upwardly extending tabs 78 project substantially orthogonally from the shield flat portion 74, one tab 78 being disposed adjacent to each of the locking tabs 60 and 62 of the base 14. An opening 78*a* is disposed in each of the tabs 78 for receipt and engagement with the protuberance 46 on the upper shield 16, such that upon assembly of the connector 10, the upper shield 16 and the lower shield 18 are in electrical connection. The lower shield 18 has suitable openings in the flat portion 74 to spacedly receive the posts 63 on the base floor 50, such that the posts 63 may extend upwardly therethrough. The shield 18 further includes an upstanding wall 75 disposed against base partition 58, the shield wall 75 having an open slot 75*a* formed therein in registry with partition slot 58*a*. Slot 75*a* has a dimension approximately equal to the dimension of slot 58*a*. The shield slot 75*a* and wall 75 serve as a means of electrically connecting a braided shield of an electrical cable and as a strain relief means for the cable.

Figure 4:
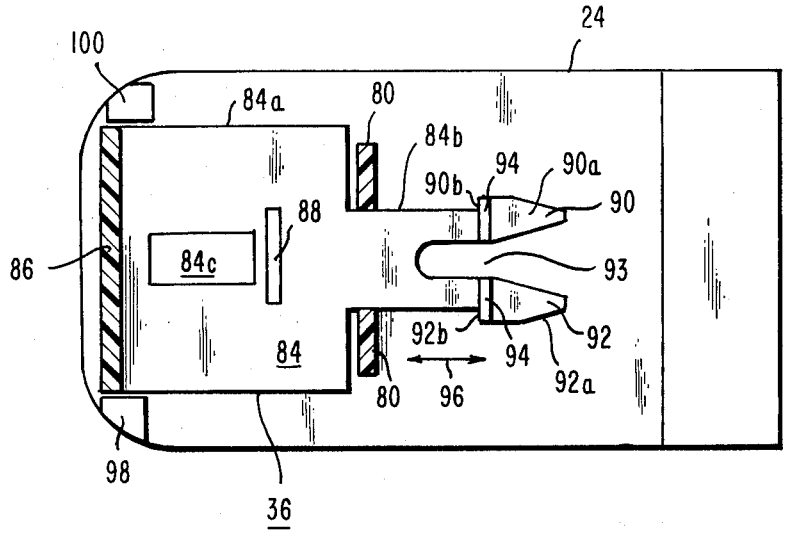
FIG. 4 is a cross-sectional view as seen along viewing lines IV—IV of FIG. 1.
Figure 3:
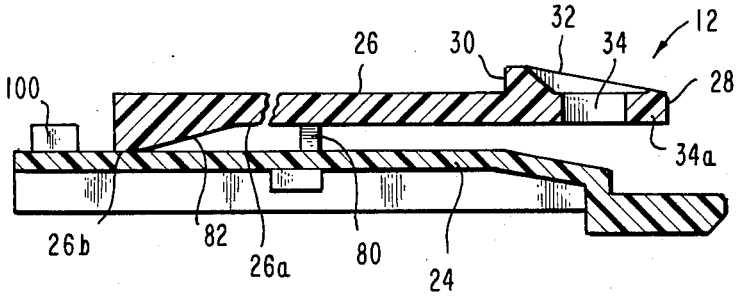
FIG. 3 is a cross-sectional view of the connector cover as seen along viewing lines III—III of FIG. 3, with the sliding lever being eliminated to facilitate the description thereof.

By reference now to FIGS. 3 and 4, the details of the connector latching mechanism and the sliding levers on the cover and base may be more fully understood. The sliding levers on the cover and base are preferably identical in construction and function, so that by describing the lever 36 on the cover 12, it will be appreciated that these details also apply to the lever 72 on the base 14. FIG. 3 illustrates the cover 12 in cross-section, absent the lever 36. The deflectable arm 26 is attached to the cover lid 24 by a flexible web 80 such that the arm 26 is upwardly spaced from and pivotably movable on the lid 24. In the present form, the web is provided in two portions that are spaced transversely in the cover 12, defining an opening therebetween. The arm 26 includes adjacent an end facing the rearward end of the cover 12 a cam surface 82 sloping downwardly from the arm bottom surface 26*a* toward the rear end of the cover 12. The web 80 is disposed intermediate the cam surface 82 and the latch portion 28 so that the latch portion and cam surface 82 can pivot thereabout.

With further reference to FIG. 1 and also now to FIG. 4, the lever 36 comprises a generally flat actuator plate 84 having a rear portion 84*a* and a narrower front portion 84*b*. At the rear portion of the plate 84, there is an upstanding handle 86 (FIG. 1) adapted to be manually grasped by the connector user. Also at the rear portion 84*a*, there is an opening 84*c* extending through the plate 84 and disposed at a location such that a bottom portion 26*b* of the arm 26 (FIG. 3) including the cam surface 82 may reside therein when the lever 36 is in the position shown in FIGS. 1 and 4, the arm bottom portion 26*b* contacting the upper surface of the lid 24. Adjacent the opening 84*c* on the rear portion 84*a* is an upstanding wall 88 serving as a cam for engaging the arm cam surface 82. At the distal end of the front portion 84*b*, there are a pair of defelectable tines 90 and 92 defined by a slot 93 extending therebetween. The slot 93 permits resilient deflection of the tines 90, 92 laterally toward each other. The front surfaces 90*a* and 92*a* of the tines are tapered to permit entry of the lever front portion 84*b* between the two transversely spaced portions of the web 80 on the cover. Upon insertion of the front portion 84*b* between the spaced webs 80, the tines 90 and 92 will deflect, upon engagement with the webs 80. Upon continued insertion and once past the webs 80, the tines 90 and 92 will spring outwardly back, thereby captivating the lever 36 as the webs 80 are disposed between the lever rear portion 84*b* and the rearwardly facing shoulders 90*b* and 92*b* on the tines. Also located on the front portion 84*b* spacedly on each tine 90 and 92 is another upwardly extending wall 94 serving as a locking spacer for engaging the lower surface 26*a* of the arm 26. It should be noted that as captivated in the cover between the lid 24 and the arm 26, the lever 36 is slidably movable in the direction as shown by the arrow 96. Thus, the cam 88 is movable between the cam surface 82 and the web 80, while the spacer 94 is movable between the web 80 and the latch portion 28. Located on the upper surface of the cover lid 24 is a pair of transversely spaced bosses 98 and 100 for maintaining the lever 36 in a relatively straight line during its sliding inward and the outward movement on the cover 12.

Figure 5:
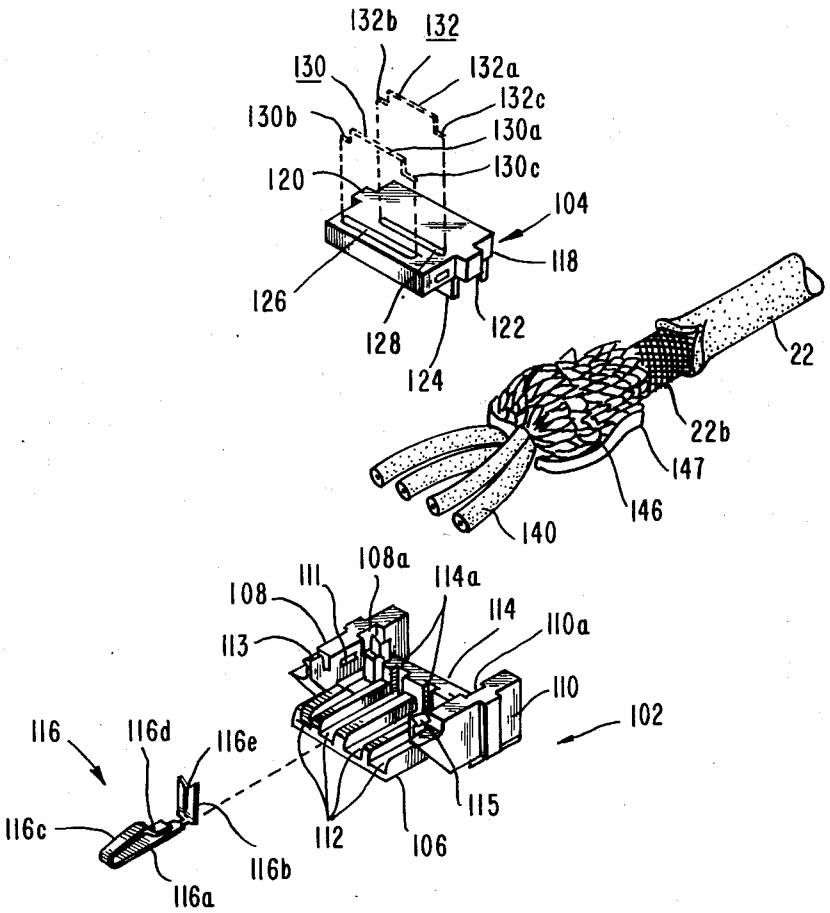
FIG. 5 is an exploded, perspective view of the connector cable termination sub-assembly, showing a shielded, electrical cable in position for termination thereto.

Referring again to FIG. 2 and also now to FIG. 5, the details of the cable termination sub-assembly 20 are described. The sub-assembly 20 comprises an electrically insulative contact holder 102 and an electrically insulative conductor holding block 104. Holder 102, peferably formed of a molded plastic material, comprises a bottom wall 106 and two transversely spaced, upstanding sidewalls 108 and 110. A plurality of spaced, substantially parallel channels 112 are provided in the bottom wall 106. Sidewalls 108 and 110 each have a recess 108*a* and 110*a* formed in their interior surfaces. A transverse wall 114 of height less than the sidewalls extends across the bottom wall 106 and has slots 114*a* provided therein. Upwardly extending latching elements 113 and 115 are provided on the sidewalls for retentive coupling with openings 24*a* in the cover lid 24 when the connector is assembled. In addition, openings 111 (only one of which can be seen in FIG. 5) are provided in the interior surface of each of the sidewalls for retentive engagement with the conductor holding block 104.

A plurality of electrical contacts 116 are supported by the holder 102. The contacts 116 are formed of a suitable conductive material, such as phosphor bronze, and comprise a generally elongate base portion 116*a* ,an insulation displacement contact (IDC) portion 116*b*, a folded-over, resiliently deflectable tongue portion 116*c* and an offset flat portion 116*d* disposed at the distal, free end of the folded-over-tongue portion 116*c*. The IDC portion 116*b* is of conventional, generally flat, blade-type configuration having two relatively sharp tines with a cable conductor receiving slot 116*e* provided therebetween. The contacts 116 are fixedly secured in the holder 102 with the contact base portions 116*a* each residing in a respective channel and an IDC portion 116*b* residing in a respective slot 114*a*, the IDC portions projecting above the top surface of transverse wall 114. While in the preferred arrangement there are four contacts 116 shown, it should be appreciated that any suitable number of contacts may be used.

Figure 6:
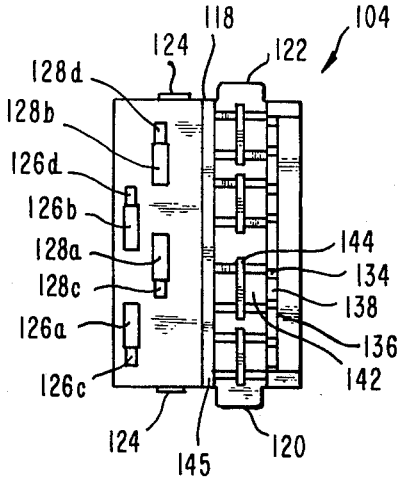
FIG. 6 is a bottom plan view of the sub-assembly conductor holding block.

Still referring to FIGS. 2 and 5, the conductor holding block 104 comprises a generally flat body 118, preferably of molded plastic, with a pair of ribs 120 and 122 extending from two opposite ends thereof, ribs 120 and 122 adapted to be received in the slots 108*a* and 110*a* of the contact holder 102. Also, adjacent ribs 120, 122 on each end of the body 118 is a latching ledge 124 for resilient receipt into the openings 111 of the holder 102. Extending across the body 118 between the opposite ends thereof is a pair of spaced, elongate slots 126 and 128, each slot being of approximately the same length but offset relative to the other and extending only partially into the upper surface of body 118. As shown in FIG. 6, at each longitudinal end of each slot there is an opening extending through the body 118, the openings being designated as 126*a*, 126*b* and 128*a*, 128*b*. Recesses communicating with the openings and extending only partially into the bottom surface of the body 118 are provided, the recesses being designated as 126*c*, 126*d* and 128*c*, 128*d*.

As illustrated in FIG. 5, a pair of shorting bars 130 and 132 are provided for retentive support in the block 104. The bars each comprise an elongate shaft 130*a* and 132*a* and a pair of extending terminals 130*b*, 130*c* and 132*b*, 132*c*, the terminals being formed as feet, extending in the same axial direction, but offset from and substantially parallel to the bar shafts. In the holding block 104, the bars 130 and 132 are supported such that the shafts 130*a* and 132*a* reside in the upper slots 126 and 128, respectively and the terminals 130*b*, 130*c* and 132*b*, 132*c* extend through openings 126*a*, 126*b* and 128*a*, 128*b* and reside in lower body surface recesses 126*c*, 126*d* and 128*c*, 128*d*, respectively. As the shorting bars 130 and 132, the function of which will be explained, are contained with their shafts and terminals in slots and recesses with the body insulation in substantial surrounding relation, these bars are supported in the block 104 with minimum exposure. The shorting bars 130 and 132 are preferably made of phosphor bronze wire, but any suitable metal may be used.

Referring again to FIG. 6, the bottom of the conductor holding block 104 comprises a plurality of conductor retainers, one for each cable conductor to be terminated to an IDC portion 116*b* on the contact holder 102. In the holding block 104 being described, there are four such retainers, each of substantially identical construction. The retainer includes a pair of spaced walls 134 and 136 defining a slot 138 therebetween. Slot 138 is of dimension to frictionally receive and hold an insulated conductor 140 (FIG. 5) therein. Adjacent the walls 134 and 136 and communicating with the slot 138 is a cradle 142, bisected by a deeper groove 144. The groove 144 is adapted to freely receive the IDC portion 116*b* of the electrical contacts 116 upon insulation displacement termination with the insulated conductor 140, the bottom walls of the cradle 142 providing support on either side of the conductor during termination. A back wall 145 provides a mechanical stop for the conductors 140 upon being dressed into the slot 138, the abutment of the free conductor end theregainst providing assurance that the conductor traverses the groove 144 that is to receive the IDC portion of the electrical contact.

Figure 7:
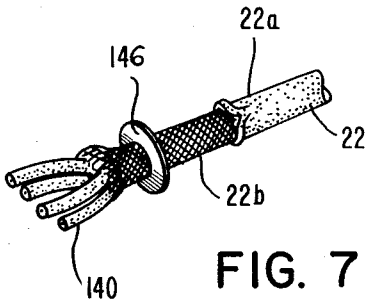
FIG. 7 is a perspective view of a shielded, electrical cable in preparation for termination in the connector cable termination sub-assembly.
Figure 8:
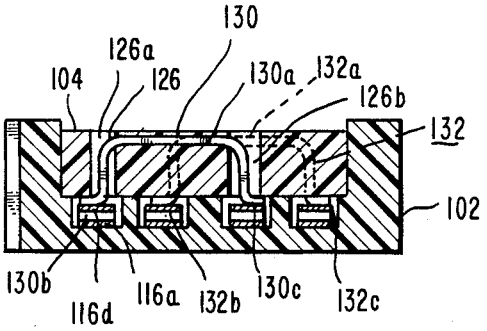
FIG. 8 is a cross-sectional view of the connector cable termination sub-assembly as seen along lines VIII—VIII of FIG. 2 and showing details in phantom for purposes of illustration and description.

In terminating an electrical cable 22 preferably of the shielded type and assembling the connector 10, the cable 22 is prepared, as shown in FIG. 7 by peeling back the outer cable insulative jacket 22*a*, exposing an extent of shielding braid 22*b* and exposing the insulated conductors 140. A flat metal washer 146 is slid over the braid 22*b* and, as shown in FIG. 5, the braid 22*b* is folded back over the washer 146. Aluminized insulation 147 that may surround each pair of conductors 140, for example, is peeled back and removed from cable 22. The conductors 140 are retentively dressed in the respective slots 138 in the bottom of the holding block 104 and the contact holder 102 is then joined with the block 104. Upon joining the holder 102 and the block 104, the IDC portions 116*b* of the contacts, displace the insulation around the conductors 140 and make electrical engagement with conductors therein, the IDC portions being accommodated in the block grooves 144. In addition, the shorting bars 130 and 132 are in engagement with the electrical contacts 116. As illustrated in FIG. 8, the terminal 130*b* is shown contacting the leftward-most electrical contact at its flat, deflectable portion 116*d* while terminal 130*c* is contacting the third contact from the left. Similarly, as shown in phantom, terminal 132*b* contacts the second contact from the left, while terminal 132*c* contacts the fourth contacts from the left. As such, through shorting bar 130 the first and third contacts are in electrically common connection and the second and fourth contacts are in electrically common connection. The second contact is bridged by the axial shaft 130*a*, while the tird contact is bridged by the axial shaft 132*a*. In this manner, the first and third cable conductors, for example are releasably maintained in a closed-loop condition and the second and fourth cable conductors are also releasably maintained in a closed-loop condition in the termination sub-assembly 20 as will be explained.

Figure 9B:
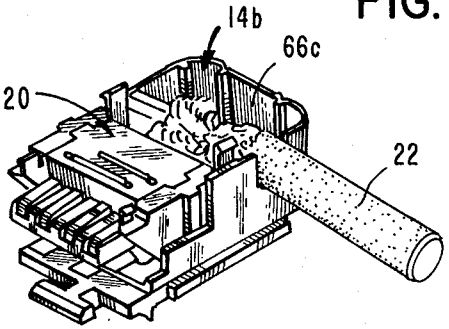
FIGS. 9*a*, 9*b*, and 9*c* are perspective views of the electrical connector in partial assembly, showing the capability of the connector for different cable exiting directions.
Figure 9A:
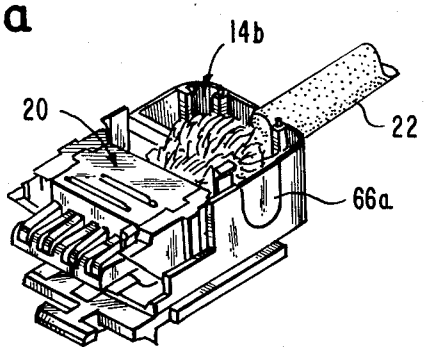
Figure 9C:
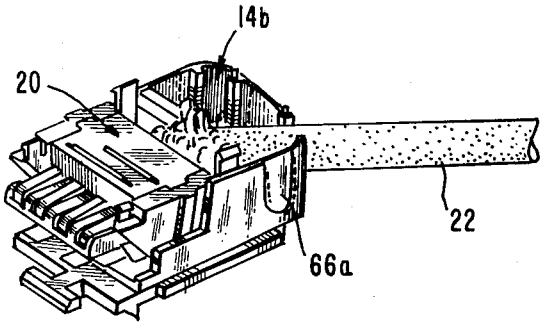

Referring now again to FIG. 2, the cable termination sub-asembly 20 with cable 22 terminated thereto is then joined to the base 14 with the shield 18 assembled thereon. One of the gates to the accessible cable ports is removed depending upon which direction the cable 22 is to exit. For example, if the cable is to exit in the axial direction (see FIG. 9*a*) then gate 66*c* will be removed. Similarly, for cable exiting at the orthogonal direction (FIG. 9*b*), gates 66*a* or 66*e* will be removed or for cable existing at the 45° direction (FIG. 9*c*), gates 66*b* or 66*d* will be removed. In joining the sub-assembly 20 to the shielded base 14, the washer 146 on the cable 22 is disposed in the front compartment 14*a*, with the folded-back braid 22*b* extending through the shield wall opening 75*a* and the partition opening 58*a*. Pulling the cable axially from the rear causes the washer 146 to compress the shielding braid 22*b* against the shield wall 75, transferring the pulling stresses to the braid 22*b* and thereby providing cable strain relief without radially compressing the cable 22. Engagement of the braid 22*b* with the shield wall 75 also provides a common electrical connection between the shield 18 and the cable shielding braid 22*b*. It can also be seen by reference to FIGS. 9*a*–9*c*, that compartment 14*b* is sized to accommodate bending of the electrical cable from the strain relief loction at the shield wall opening 75*a* to any of the selected ports. Furthermore, as the cable braid 22*b* electrically engages the shield wall 75 at the same interior strain relief location in the base 14 for cables exiting in any of the available directions, the compartment 14*b*, in the preferred embodiment, does not require shielding.

In joining the cable termination sub-assembly 20 to the base 14, the latching elements 113 and 115 on the sub-assembly 20 are engaged with the base openings, 52*a* and 54*b* for securement therein. The cover 12, with the upper shield 16 attached thereto by tines 48 is then assembled to complete the connector 10. During assembly of the shielded cover to the shielded base, the protuberances 46 on tabs 44 engage the openings 78*a* in the lower shield tabs 78. As such, the upper shield 16 and the lower shield 18 are in electrically common connection.

As depicted in FIG. 1, the connectors 10 are constructed to be electrically and mechanically joined together and attached to a wall panel 148 or the like. Prior to assembling the pair of connectors 10, as described hereinabove with reference to FIG. 8, alternating conductors, namely conductors one and three are terminated in a closed-loop condition through shorting bar 130. Similarly, conductors two and four are terminated in a closed-loop condition through shorting bar 132. Thus, when a connector 10 with terminated cable 22 is assembled, the closed-loop conditions prevent inadvertent shorting of pairs of conductors which could, by transmission of spurious signals, cause loss of data in equipment to which the cables are conducted. When a pair of connectors 10 as described herein are connected to each other, the folded over tongue portions 116*c* of the electrical contacts of opposing connectors engage each other and deflect thereby causing the contact flat portions 116*d* to be displacedly moved away from engagement with the shorting bar terminals 130*b*, 130*c* and 132*b*, 132*c*. The common connections between conductors one and three and between conductors two and four are thereby broken, permitting each conductor to be electrically connected individually to a conductor of the other connector. Also during connection of the connectors 10, the projecting tongues 42 of the upper shield on one connector engage the projecting tongues 76 of the lower shield of the inverted, other connector, thereby establishing electrical connection between the shields of the two electrical connectors.

Figure 10A:
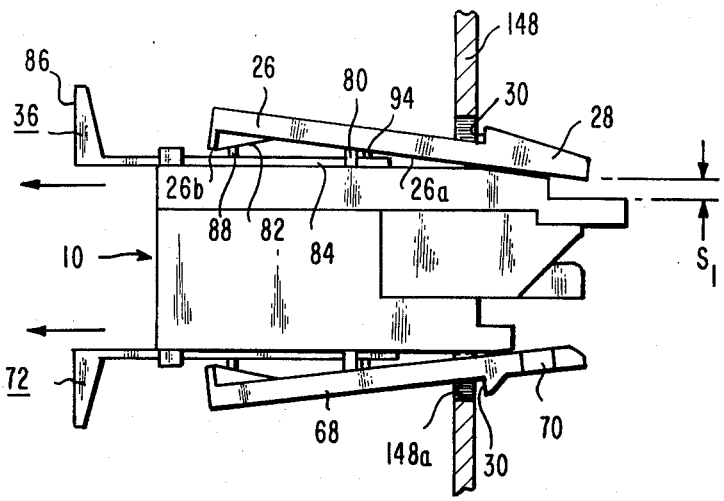
FIGS. 10*a* and 10*b* are schematic side elevational views of the connector, illustrating the operation of the connector latching mechanism for attachment to a panel of an electrical component.
Figure 10B:
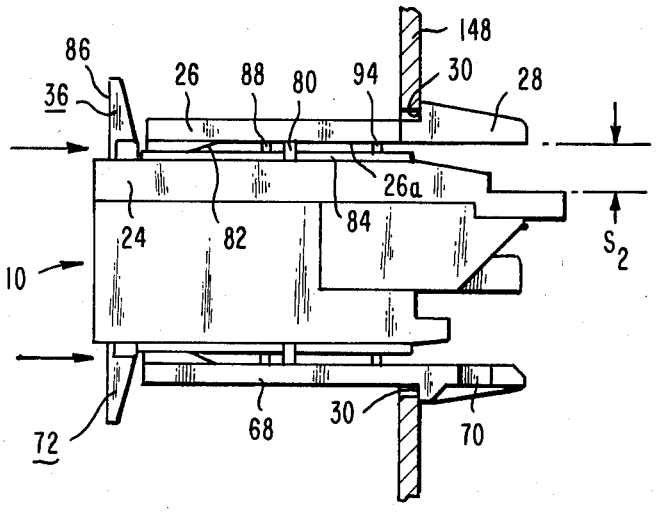

Mechanical latching and unlatching of the electrical connectors 10 to panel 148 of an electrical component, such as the wall of a data terminal are described with reference to the schematic representations shown in FIGS. 10*a* and 10*b* and to other like connectors by reference to FIGS. 10*c* and 10*d*. In FIG. 10*a*, the connectors 10 are in an unlatched condition relative to the panel 148. In this condition, the slidable levers 36 and 72 are in a first position wherein they have been pulled axially away from the connector housing. In this position, the cam 88 on the actuator plate 84 is in engagement with the cam surface 82 on the arm 26. The spacer 94, in this position is adjacent the webs 80 and the latch portion 28 has been pivoted toward the connector housing. The arm 26 is thus disposed in an inclined position, pointing generally downwardly toward the connector mating front end. The front end of the latch portion 28 is spaced a distance 5, relative to the front of the lid 24. The T-bar latch 70 on the base arm 68 has been likewise moved by lever 72 to a position similar to the latch portion 28. In this condition, the front end of the connector 10, shown on the left in FIG. 10*a*, may be readily inserted through a clearance opening 148*a* in the panel 148 until the shoulders 30 on latch portion 28 and T-bar latch 70 pass through. The levers 36 and 72 are then moved, as indicated in FIG. 10*b* axially toward the connector housing to a second position. During this movement, the cam 88 slides off the cam surface 82 and toward webs 80. The spacer 94 moves toward the latch portion 28 engaging the arm undersurface 26*a* and thus pivoting the latch portion 28 upward away from the connector to a generally horizontal position. In this second position, the arm is generally parallel to the lid 24 and the front end of the latch portion 28 is spaced a distance Srelative to the front of the lid 24, the spacing $S_2$ being greater than the spacing $S_1$. The upward movement of the arm 26 causes the shoulder 30 to engage the panel 148, providing a mechanical latch thereto. Locking is effected in the second position inasmuch as the spacer 94, positioned away from the flexible webs 80 and toward the latch portion 28, serves as a stop substantially preventing movement of the latch portion 28 toward the connector housing, and the arm bottom portion 26*b*, contacting the upper surface of the lid 24 through the opening 84*c* (FIG. 4) of the lower 36, substantially prevents downward movement of the rear portion of the arm 26. Inward movement of the lever 72 similarly moves arm 68 and locks the arm 68 to the panel 148.

Figure 10C:
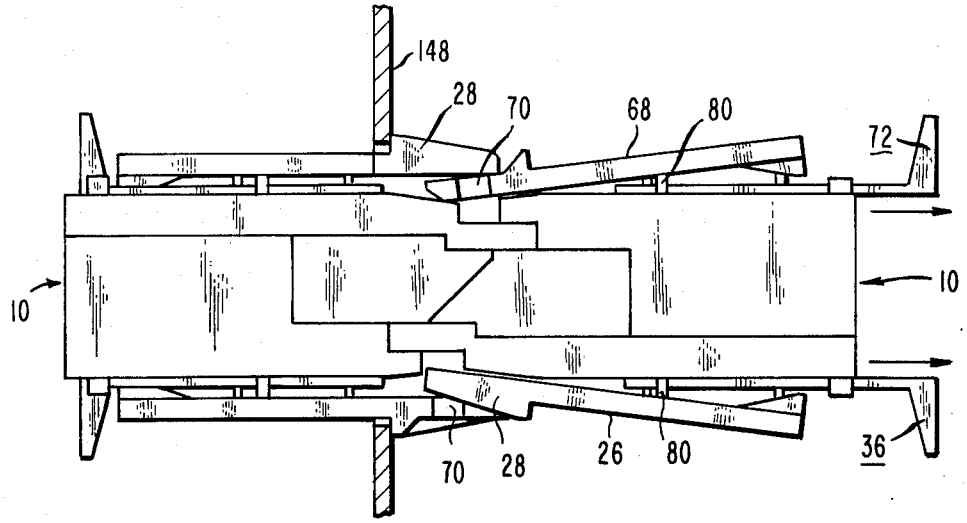
FIGS. 10*c* and 10*d* are schematic, side elevational views of the connector, illustrating the operation of the connector latching mechanism for attachment to a like electrical connector.
Figure 10D:
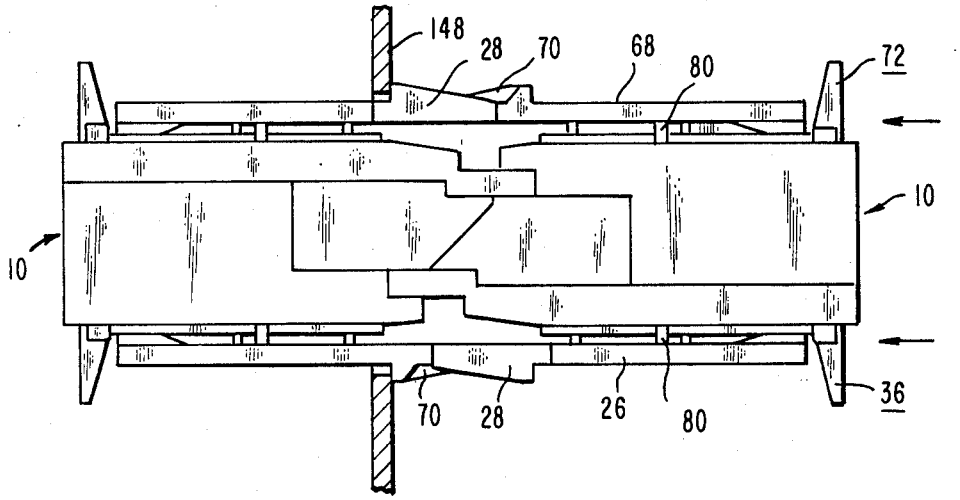

By reference now to FIGS. 10*c* and 10*d*, latching and unlatching of the connectors 10 to each other are shown. For example, connecting the connector (on the right) to another connector (on the left) that has already been latched to a panel 148 of an electrical component, is effectively accomplished in the same manner as the connector was attached to the panel. As such, the levers 36 and 72 are axially pulled out as in FIG. 10*c*, pivotally deflecting the arms 26 and 68 about the webs 80 until the latch portion 28 and T-bar latch 70 are moved substantially transversely toward the connector housing. This permits electrically mating the two connectors in an unlocked relation with the latch portions 28 and the T-bar latches 70 in non-engaged juxtaposition. As shown in FIG. 10*d*, axial movement of the levers 36 and 72 inward toward the connector housing, moves the arms 26 and 68 pivotally into a generally horizontal position and causes latching engagement between the respective T-bar latches 70 into the C-shaped openings of the latch portions 28. Locking is established as the arms 26 and 68 are substantially prevented from movement relative to the connector housings.

Having described the preferred embodiments improved features of the electrical connector herein, it should be appreciated that variations may be made thereto without departing from the contemplated scope of the invention. For example, while each connector has been described as including two sliding levers in the latching mechanism, it should be appreciated that any suitable number may be used, depending upon the particular applications. Also, the connector may be utilized to receive multiple electrical cables through different ports in the second compartment thereof with conductors from each cable being terminated in the sub-assembly. In the instance, a larger washer may be used to commonly surround the cables for engagment with the cable shielding braids and for strain relief. As such, the embodiments described herein are intended to be illustrative and not limiting, the true scope of the invention being set forth in the claims appended hereto.

We claim:

1. A shielded electrical connector comprising:

a housing defining a mating end for electrical connection to an electrical component and a cable receiving end for receipt of an electrical cable having a plurality of electrical conductors encased in an outer insulative jacket, said housing including first and second communicating compartments, said first compartment being adjacent said mating end of said housing and supporting a plurality of electrical contacts therein for electrical engagement with said conductors of said cable, said housing supporting an electrically conductive shield in said first compartment, strain relief means disposed between said first and second compartments for engaging a portion of said cable and retaining said cable thereat, said second compartment having walls defining a plurality of accessible ports for receipt of said cable in selectively different directions, said second compartment being of sufficient size to accommodate bending of said cable therein from said strain relief means to any one of said ports.

2. A shielded electrical connector according to claim 1, wherein said housing comprises a base and a cover detachably secured thereto.

3. A shielded electrical connector according to claim 2, wherein said conductive shield comprises an upper shield member attached to said cover and a lower shield member attached to said base, said upper and lower shield members including cooperative latching means for joining said upper and lower shield members in common electrical connection upon joining said cover and said base.

4. A shielded electrical connector according to claim 2, wherein said base supports a lower shield member having a wall substantially dividing said first and second compartments.

5. A shielded electrical connector according to claim 4, wherein said wall has an open slot therein for receipt of a portion of said cable, said wall with said slot defining said connector strain relief means.

6. A shielded electrical connector according to claim 4, wherein said cover supports an upper shield member, said upper and said lower shield member defining said electrical conductive shield and extending only in said first compartment.

7. A shielded electrical connector according to claim 5, wherein said housing includes a partition adjacent said wall and includes an open slot therein for receipt of said cable, said slot in said partition being in substantial registry with the slot in said wall.

8. A shielded electrical connector according to claim 1, wherein said accessible ports are defined by slidably removable gates.

9. A shielded electrical connector according to claim 8, wherein said base includes walls defining said second compartment and wherein said slidably removable gates are on said base.

10. A shielded electrical connector for electrical attachment to a shielded electrical cable of the type including a plurality of electrical conductors, a shielding member and an outer insulative jacket, comprising:

a housing defining a mating end for electrical connection to an electrical component and a cable receiving end for receipt of said electrical cable, said housing defining first and second communicating compartments, said first compartment being disposed adjacent said connector mating end and supporting a plurality of electrical contacts therein, an electrical shield at least in said first compartment and including a conductive wall between said first and second compartments, said wall including means for providing electrical engagement with said cable shielding member and for providing cooperative strain relief thereto, said second compartment having walls defining at least one accessible port for exiting of said cable, said at least one accessible port being spaced from said shield wall a sufficient spacing to accommodate bending of said cable in said second compartment.

11. A shielded electrical connector according to claim 10, wherein said housing includes a base and a separable cover thereon and wherein said base supports said conductive wall and includes said second compartment walls defining said at least one accessible port.

12. A shielded electrical connector according to claim 11, wherein said conductive wall includes an open slot for receipt of said cable and said cable shielding member therein, a surface of said conductive wall adjacent said slot adapted to engage said cable shielding member upon receipt of said cable in said slot.

13. A shielded electrical connector according to claim 12, wherein there are a plurality of accessible ports spaced around base walls defining said second compartment.

14. A shielded electrical connector according to claim 13, wherein said accessible ports are each defined by a replaceably removable member.

15. A shielded electrical connector according to claim 14, wherein said replaceably removable members are slidable gates.

* * * * *

US004619494B1

REEXAMINATION CERTIFICATE (1786th)

United States Patent [19]

Noorily et al.

[11] B1 4,619,494

[45] Certificate Issued Sep. 15, 1992

[54] SHIELDED ELECTRICAL CONNECTOR

[75] Inventors: Peter Noorily, Bridgewater; Joseph P. Slachetka, Ringoes, both of N.J.

[73] Assignee: Thomas & Betts Corporation, Raritan, N.J.

Reexamination Request:
No. 90/002,369, Jun. 17, 1991

Reexamination Certificate for:

| | |
|---|---|
| Patent No.: | **4,619,494** |
| Issued: | **Oct. 28, 1986** |
| Appl. No.: | **785,313** |
| Filed: | **Oct. 7, 1985** |

[51] Int. Cl.[5] ..... H01R 13/20; H01R 13/58
[52] U.S. Cl. ..... 439/449; 439/607
[58] Field of Search ..... 439/607-610, 439/449, 965, 466

[56] References Cited

U.S. PATENT DOCUMENTS

| | | | |
|---|---|---|---|
| 4,009,923 | 3/1977 | Aistleitner | 439/610 |
| 4,120,553 | 10/1978 | Muz | 439/352 |
| 4,127,315 | 11/1978 | McKee | 439/468 |
| 4,215,236 | 7/1980 | Reiser | 174/59 |
| 4,272,148 | 6/1981 | Knack | 439/455 |
| 4,358,178 | 11/1982 | Guy | 439/464 |
| 4,382,649 | 5/1983 | Meyer | 339/39 |
| 4,398,780 | 8/1983 | Novotny et al. | 439/284 |
| 4,415,223 | 11/1983 | Asick | 439/610 |
| 4,449,778 | 5/1984 | Lane | 439/610 |
| 4,453,798 | 6/1984 | Asick et al. | 439/581 |
| 4,457,576 | 7/1984 | Cosmos et al. | 439/610 |
| 4,493,525 | 1/1985 | Hall et al. | 439/610 |
| 4,501,459 | 2/1985 | Chandler et al. | 439/289 |
| 4,508,414 | 4/1985 | Kusui et al. | 439/610 |
| 4,508,415 | 4/1985 | Bunnell | 339/143 R |
| 4,549,780 | 10/1985 | Bertini et al. | 339/107 |

FOREIGN PATENT DOCUMENTS

| | | |
|---|---|---|
| 0112713 | 7/1984 | European Pat. Off. . |
| 8501658 | 5/1985 | Fed. Rep. of Germany . |
| 2137538 | 12/1972 | France . |
| 50-88581 | 7/1975 | Japan . |
| 59-171479 | 5/1984 | Japan . |
| 60-67677 | 5/1985 | Japan . |

OTHER PUBLICATIONS

IBM Tech. Discl. Bull., "Hermaphroditic Connector", R. T. Evans, vol. 16, No. 5, Oct. 1973, pp. 1505-1506.
Publication (Author unknown) No. GA27-3579-1, 5 pages, date unknown.

*Primary Examiner*—Eugene F. Desmond

[57] ABSTRACT

A shielded electrical connector is provided for electrical attachment to a shielded electrical cable of the type including a plurality of electrical conductors and a shielding braid surrounding the conductors. The connector includes an electrically insulative housing including a base and a separable cover attached thereto, the housing defining a mating end for electrical connection to an electrical component and a cable receiving end for receipt of the electrical cable. The housing base defines first and second open compartments divided by a partition extending therebetween. The first compartment is disposed adjacent the connector mating end and supports a plurality of electrical contacts therein. In the preferred arrangement, only the first compartment of the connector is electrically shielded. Shielding is provided by a conductive member including at least one conductive wall between the first and second compartments, the wall including an open slot for receipt of and engagement with the shielding braid of the electrical cable. Engagement with the conductive wall provides not only electrical connection to the cable shielding braid, but also provides cooperative strain relief thereto. The second compartment includes walls define a plurality of accessible ports for receipt of the cable in selectively different directions. These accessible ports are preferably in the form of slidably removable gates mounted on the base walls. The second compartment is of sufficient size to accommodate bending of the cable therein from the strain relief to any one of the accessible ports.

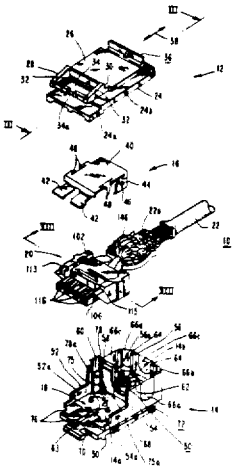

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2, 4–6, 8, 9 and 12 are cancelled.

Claims 3, 7, 10 and 13 are determined to be patentable as amended.

Claims 11, 14 and 15, dependent on an amended claim, are determined to be patentable.

New claims 16–33 are added and determined to be patentable.

3. A shielded electrical connector according to claim [2] *11*, wherein said conductive shield comprises an upper shield member attached to said cover and a lower shield member attached to said base, said upper and lower shield members including cooperative latching means for joining said upper and lower shield members in common electrical connection upon joining said cover and said base.

7. A shielded electrical connector according to claim [5] *10*, wherein said housing includes a partition adjacent said wall and includes an open slot therein for receipt of said cable, said slot in said partition being in substantial registry with the [slot] *opening* in said wall.

10. A shielded electrical connector for electrical attachment to a shielded electrical cable of the type including a plurality of electrical conductors, a shielding member and an outer insulative jacket, comprising:

a housing defining a mating end for electrical connection to an electrical component and a cable receiving end for receipt of said electrical cable, said housing defining first and second communicating compartments, said first compartment being disposed adjacent said connector mating end and supporting a plurality of electrical contacts therein, an electrical shield at least in said first compartment and including a conductive wall between said first and second compartments, said wall [including] *having an opening therethrough of predetermined size for passage of a portion of said cable and said cable shielding member into said first compartment and into said shield, and conductive* means *disposed within said shield* for providing electrical engagement with said cable shielding member and for providing cooperative strain relief thereto, *said conductive means comprising an apertured element having an inner aperture and a peripheral extent greater than said predetermined size of said wall opening, the apertured element adapted to receive a portion of said cable through said aperture and said cable shielding member on said peripheral extent and to press said shielding member against an interior surface of said wall along an axial direction of said cable,* said second compartment having walls defining at least one accessible port for exiting of said cable, said at least one accessible port being spaced from said shield wall a sufficient spacing to accommodate bending of said cable in said second compartment.

13. A shielded electrical connector according to claim [12] *10*, wherein there are a plurality of accessible ports spaced around base walls defining said second compartment.

*16. A shielded electrical connector according to claim 10, wherein said apertured element is a washer.*

*17. A shielded electrical connector according to claim 10, wherein said apertured element is adapted to receive said cable shielding member through said aperture and reversely over its peripheral extent toward the cable receiving end of said housing.*

*18. A shielded electrical connector comprising:*

*a housing defining a mating end for electrical connection to an electrical component and a cable receiving end for receipt of an electrical cable having a plurality of electrical conductors and a shielding member encased in an outer insulative jacket, said housing adjacent said mating end supporting a plurality of electrical contacts therein for electrical engagement with said conductors of said cable, said housing supporting therein an electrically conductive shield, said electrically conductive shield including a conductive wall disposed interiorly within said housing between said housing mating end and said housing cable receiving end, said wall having an opening therethrough for receipt of a portion of said cable, an apertured element disposed within said shield and being adjacent said wall such that said cable shielding member may be received through an aperture in said element and through said wall opening, said element having a peripheral extent greater than the opening in said conductive wall, said apertured element adapted to receive said cable shielding member on said peripheral extent and to engage said cable shielding member in a manner to compress said shielding member between said apertured element and an interior surface of said conductive wall along an axial direction of said cable upon application of a pulling force on said cable from said cable receiving end to thereby provide electrical engagement between said wall and said shielding member and to provide strain relief for said cable, said cable receiving end of said housing including a wall defining at least one accessible port for exiting of said cable.*

*19. A shielded electrical connector as claimed in claim 18, wherein said housing includes a first compartment adjacent said mating end, said first compartment including said electrical shield and supporting said plurality of electrical contacts therein.*

*20. A shielded electrical connector as claimed in claim 19 wherein said housing includes walls defining a second compartment communicating with said first compartment, said at least one accessible port being located at one of said walls, said second compartment being of sufficient size to accommodate bending of said cable therein from said conductive wall to said accessible port.*

*21. A shielded electrical connector as claimed in claim 18, wherein said apertured element is a washer.*

*22. A shielded member according to claim 21, wherein said washer is formed of substantially flat metal.*

*23. A shielded electrical connector as claimed in claim 18, wherein said electrically conductive shield comprises an upper shield member, a spaced lower shield member and said conductive wall, said conductive wall and at least one of said upper shield member of said lower shield member being formed as a one-piece, unitary member.*

*24. A shielded electrical connector according to claim 18, wherein said apertured element is adapted to receive said cable shielding member through said aperture and wherein said shielding member is adapted to be folded reversely over said peripheral extent toward the cable receiving end of said housing.*

*25. A shielded member according to claim 18, wherein said apertured member comprises a conductive material.*

*26. A shielded electrical connector comprising:*

*an insulative housing defining a mating end for electrical connection to an electrical component and a cable receiving end for receipt of an electrical cable having a plurality of electrical conductors and a shielding member encased in an outer jacket, said housing supporting therein an electrically conductive shield, said shield comprising an upper shield member and a lower shield member spaced therefrom and a conductive wall engaging said upper shield member and said lower shield member and extending generally transversely therebetween, said conductive wall being disposed interiorly within said housing between said housing mating end and said housing cable receiving end, said upper shield member, said lower shield member and said conductive wall defining a shielded compartment within said housing, said housing supporting within said shielded compartment a plurality of electrical contacts for electrical engagement with said conductors of said cable, said conductive wall having an opening therethrough for receipt of a portion of said cable inclusive of said cable shielding member, a conductive washer disposed within said shielded compartment and adjacent said conductive wall, said conductive washer having an aperture for receipt of said cable portion and said cable shielding member and having an outer edge over which said cable shielding may be folded back, said washer outer edge being of extent greater than said opening in said conductive wall such that said washer may axially compress said cable shielding member against said conductive wall in a manner to provide electrical engagement between said conductive wall and said cable shielding member and to provide strain relief for said cable, said cable receiving end of said housing including a wall defining at least one accessible port for exiting of said cable.*

*27. A shielded electrical connector according to claim 26, wherein said conductive wall is formed as an integral, one-piece member with either of said upper shield member or said lower shield member.*

*28. A shielded electrical connector according to claim 26, wherein said housing mating end defines mating surfaces rendering said electrical connector hermaphroditic, whereby said electrical connector may be connected to a like hermaphroditic electrical connector.*

*29. A shielded electrical connector according to claim 26, wherein said washer comprises a continuous ring.*

*30. A shielded electrical connector according to claim 26, wherein said washer aperture is generally circular.*

*31. A shielded electrical connector according to claim 26, wherein said washer outer edge is generally circular.*

*32. A shielded electrical connector according to claim 26, wherein said washer is substantially flat.*

*33. A shielded electrical connector according to claim 26, wherein said washer has a thickness through which said aperture extends and an extent extending transversely to said thickness, and wherein said thickness is less in dimension than said extent.*

* * * * *